US006558195B1

(12) United States Patent
Kusuhara

(10) Patent No.: US 6,558,195 B1
(45) Date of Patent: May 6, 2003

(54) ELECTRICAL CONNECTOR FOR PRINTED CIRCUIT BOARDS

(75) Inventor: Toshitaka Kusuhara, Yokohama (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/687,074

(22) Filed: Oct. 16, 2000

Related U.S. Application Data

(60) Continuation of application No. PCT/US95/16465, filed on Dec. 15, 1995, which is a division of application No. 08/860,560, filed on Jun. 27, 1997, now Pat. No. 6,159,021.

(30) Foreign Application Priority Data

Feb. 9, 1995 (JP) ..... 7-21737

(51) Int. Cl.[7] ..... H01R 13/648
(52) U.S. Cl. ..... 439/607
(58) Field of Search ..... 439/607, 108, 439/74, 79, 80

(56) References Cited

U.S. PATENT DOCUMENTS

| | | | | | |
|---|---|---|---|---|---|
| 3,587,029 | A | * | 6/1971 | Knowles | 439/607 |
| 4,906,208 | A | * | 3/1990 | Nakamura et al. | 439/607 |
| 5,030,140 | A | * | 7/1991 | Sugiyama | 439/607 |
| 5,035,631 | A | * | 7/1991 | Piorunneck et al. | 439/108 |
| 5,073,130 | A | * | 12/1991 | Nakamura | 439/607 |
| 5,195,899 | A | * | 3/1993 | Yatsu et al. | 439/101 |

* cited by examiner

*Primary Examiner*—Tulsidas Patel

(57) ABSTRACT

The object of the present invention is to provide an electrical connector which makes it possible for the contacts to electrically contact each other with a high contact pressure even when the contacts are made smaller and shorter. Contacts 40 and 80 which electrically contact each other are respectively secured in housings of a plug connector 20 and a cap connector 60, with the contacts being positioned in two rows in each connector. When the plug connector 20 and cap connector 60 are connected, first and second spring members 42 and 44 of the contacts 40 are clamped between wall surfaces 38*a* and 38*b* of the housing 30 and the contact sections 82 of the contacts 80, so that the contacts 40 and 80 are springably pressed strongly against each other.

6 Claims, 8 Drawing Sheets

ELECTRICAL CONNECTOR FOR PRINTED CIRCUIT BOARDS

This application is a continuation of international application number PCT/US/95/16465, filed Dec. 15, 1995 and a division of U.S. application Ser. No. 08/860,500 filed Jun. 27, 1997 now U.S. Pat. No. 6,159,021 issued on Dec. 12, 2000.

DETAIL OF THE INVENTION

The present invention concerns an electrical connector equipped with two connector halves which are respectively mounted on different boards, and which connect these boards to each other.

BACKGROUND

In the past, electrical connectors have been widely used in order to connect printed circuit boards, hereafter referred to as "PCB's", to each other. Such electrical connectors as disclosed in U.S. Pat. No. 5,224,866 are equipped with a plug connector and a cap connector which are mounted on different boards, and which are connected to each other. The PCB's are connected to each other by connecting the plug connector and cap connector. The plug connector and cap connector each have a plurality of contacts, and a housing in which these contacts are lined up at a given pitch. Ordinarily, the contacts lined up in the housing of the plug connector possess spring forces, so that when the plug connector and cap connector are connected, the contacts lined up in the respective housings are caused to contact each other with a given force as a result of these spring forces, thus establishing an electrical connection.

As a result of the miniaturization of electrical connectors in recent years, there has been a tendency for the contacts to become smaller, and for the pitch at which the contacts are lined up to become narrower. Furthermore, there has also been a tendency for the contacts to become shorter, in order to reduce the distance between the connected boards when the boards are connected face-to-face by such an electrical connector. In cases where the contacts are thus made smaller and shorter, the spring forces of the contacts drops so that there is a drop in the contact pressure between the contacts, thus leading to the danger of an inadequate electrical connection.

SUMMARY

The object of the present invention is to provide an electrical connector which makes it possible to cause the contacts to contact each other with a high contact pressure even if the contacts are made smaller or shorter.

The electrical connector of the present invention which is used in order to achieve the abovementioned object is an electrical connector which is equipped with a plug connector and a cap connector on which first contacts and second contacts that contact each other are respectively lined up. The connectors are respectively mounted on a first board and a second board, and connect the first board and second board to each other.

When the plug and cap connectors are connected to each other in the electrical connector of the present invention, the first contacts are clamped between the wall surfaces of the housing of the plug connector and the second contacts. In other words, when the plug and cap connectors are connected to each other, the first contacts are clamped between the wall surfaces and the second contacts, and are strongly pressed against both of these parts. As a result, even if the contacts are made smaller and shorter in order to reduce the pitch of the contacts, the first contacts and second contacts can be caused to wipingly contact each other with a high contact pressure. Furthermore, the first contacts are lined up in two rows so that the first and second spring members are mutually symmetrical in the opposing rows. As a result, the respective forces from the wall surfaces and the second contacts are balanced between the two rows, so that the first contacts and second contacts can be caused to contact each other with a high well-balanced contact pressure. Thus, an electrical connector which provides a secure electrical connection can be obtained.

BRIEF DESCRIPTION OF THE DRAWINGS

Embodiments of the electrical connector of the present invention will now be described by way of example with reference to the accompanying drawings in which:

FIG. 1 is a plan view, FIG. 2 is a side view, FIG. 3 is an end view, and FIG. 4 is a schematic plan view of a board on which the plug connector is mounted.

FIG. 6 is a plan view, FIG. 7 is a side view, FIG. 8 is an end view, and FIG. 9 is a schematic plan view of a board on which the cap connector is mounted.

FIG. 12 is a plan view, FIG. 13 is a side view, and FIG. 14 is an end view.

DETAILED DESCRIPTION OF THE PREFERRED EMBODIMENTS

A first embodiment of the electrical connector of the present invention will be described with reference to FIGS. 1 through 11.

Figure 11:
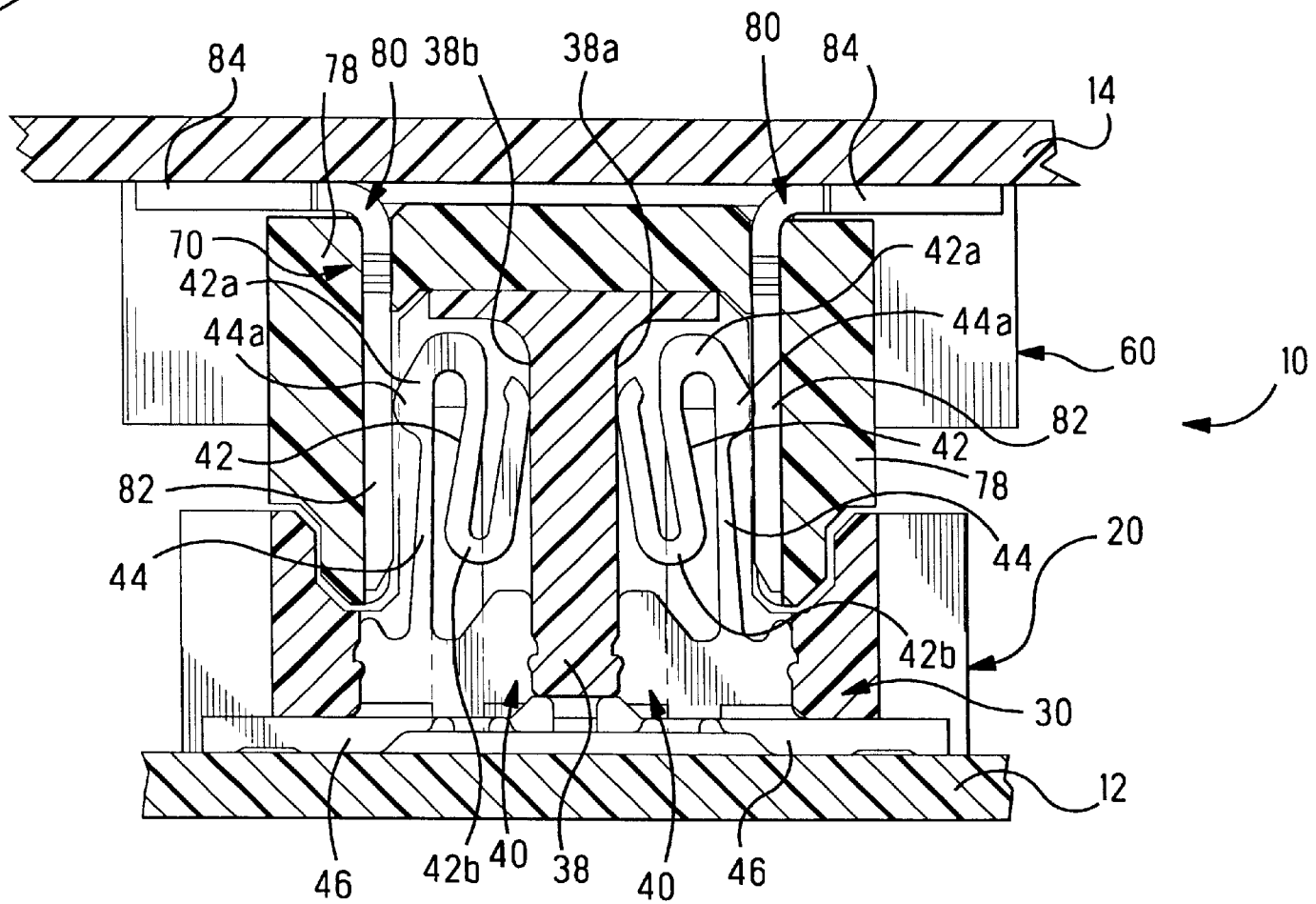
FIG. 11 is a cross-sectional view which illustrates the connected state of the plug connector shown in FIGS. 1–4 and the cap connector shown in FIGS. 6–9.
Figure 14:
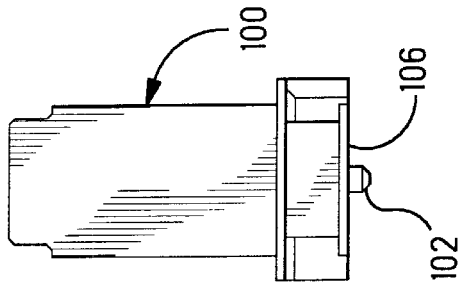
FIGS. 12–14 illustrate the cap connector in a second embodiment of the electrical connector of the present invention.
Figure 12:
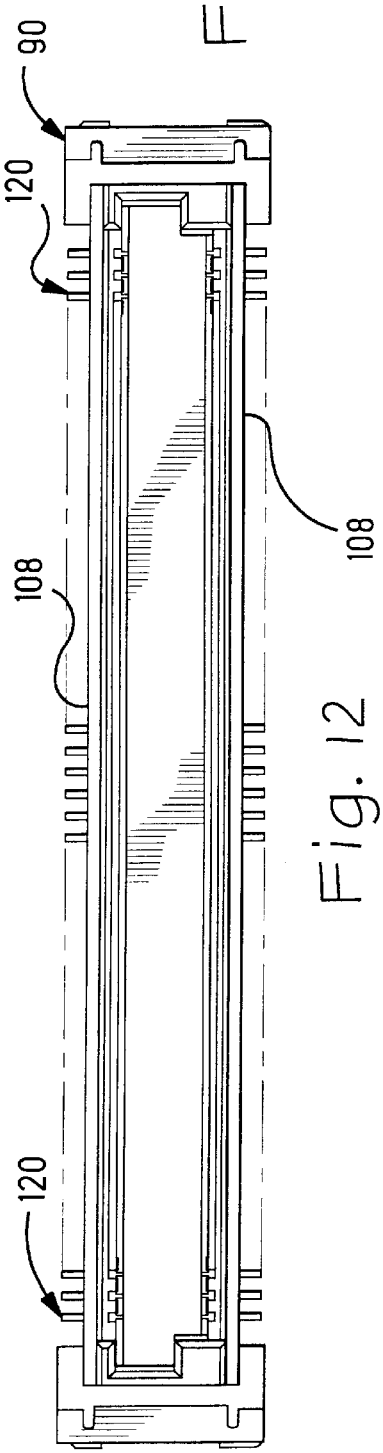
Figure 13:
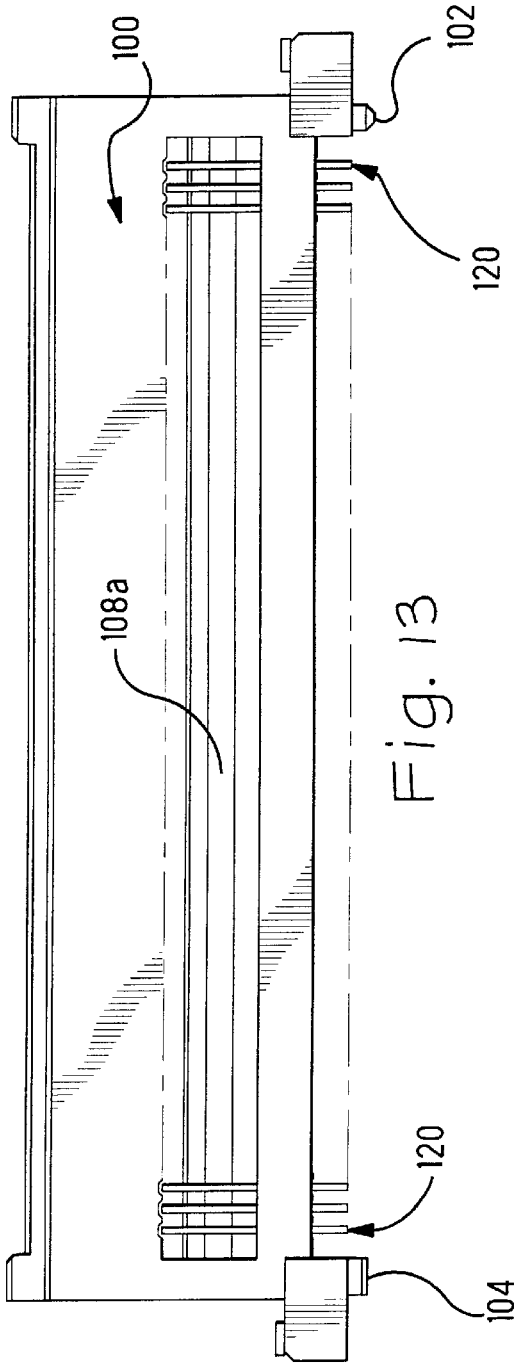

FIGS. 1–5 illustrate the plug connector of the electrical connector. A plug connector is one example of the connector referred to as the "first connector" in the present invention. FIGS. 6–10 illustrate the cap connector. A cap connector is one example of the connector referred to as the "second connector" in the present invention. FIG. 11 shows the plug connector and cap connector connected to each other.

The electrical connector 10 (FIG. 11) has a plug connector 20 and a cap connector 60 which are connected to each other. The plug connector 20 is mounted on a board 12, and the cap connector 60 is mounted on a board 14. When the plug connector 20 and cap connector 60 are connected to each other, the boards 12 and 14 are connected to each other face-to-face as shown in FIG. 11.

The plug connector 20 (FIGS. 1–5) is equipped with a housing 30 and contacts 40. The contacts 40 have projections 41, for press fitting into contact-receiving cavities of the housing 30 so as to be fastened to the housing 30, and they are aligned in two rows in the direction of the length of the housing 30. The housing 30 has posts 32 and 34 which are respectively inserted into post holes 12*a*, 12*b* formed in the board 12, and a metal-fastening fitting 36 which is soldered to a fastening pad 12*c* on the board 12. Furthermore, a central wall 38 which extends in the direction of the length of the housing 30 is formed in the central part of the housing 30. This central wall 38 has two wall surfaces 38*a* and 38*b*. Contacts 40 are comprised of contact sections 41 including S-shaped first spring members 42 which have two bent portions 42*a* and 42*b*, second spring members 44 which have contact projections 44*a* that electrically contact the contact sections 82 of contacts 80 described later, and termination sections 46 which are soldered to conductive pads 12*d* on the board 12. The contact legs 42*c* of the first spring members 42 substantially contact the wall surfaces 38*a* and 38*b*, while the second spring members 44 via contact projections 44*a* contact the contact sections 82 of the contacts 80. The contacts 40 are formed by stamping from single metal plates, which are superior in terms of conductivity and spring characteristics. The contacts 40 are installed at a pitch of 0.6 mm, and the height of the contacts 40 from the board 12 is approximately 3.00 mm.

Figure 3:
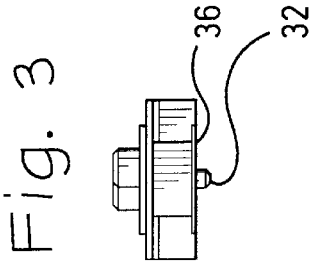
FIGS. 1–4 illustrate the plug connector in a first embodiment of the electrical connector of the present invention.
Figure 1:
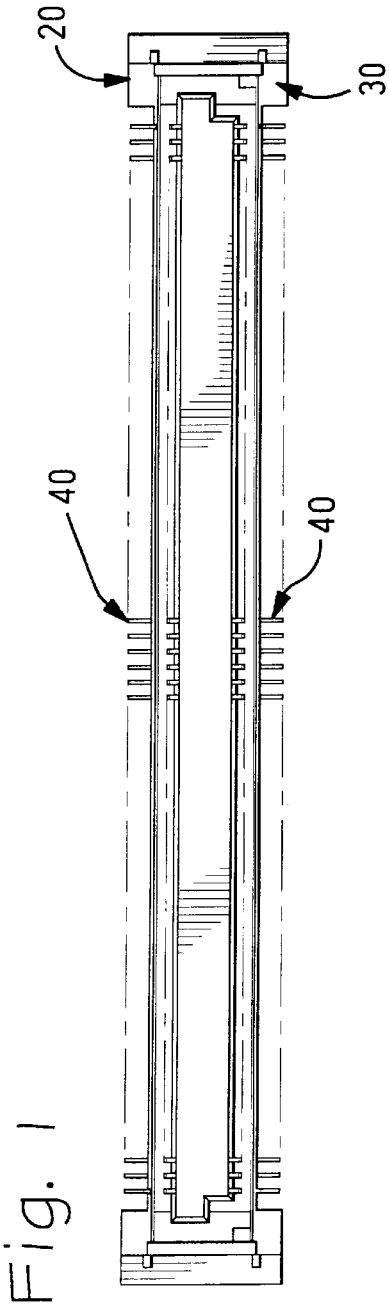
Figure 2:
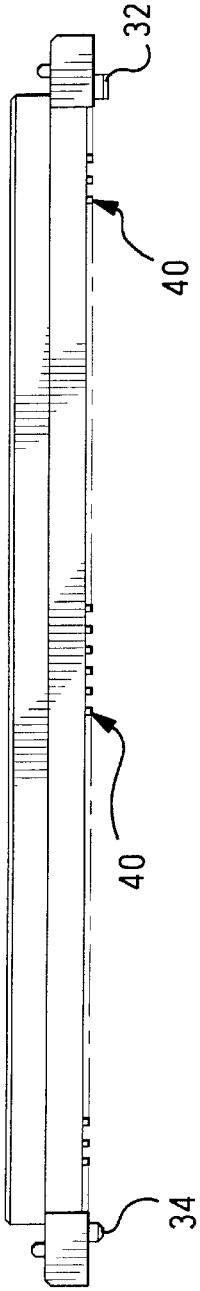
Figure 4:
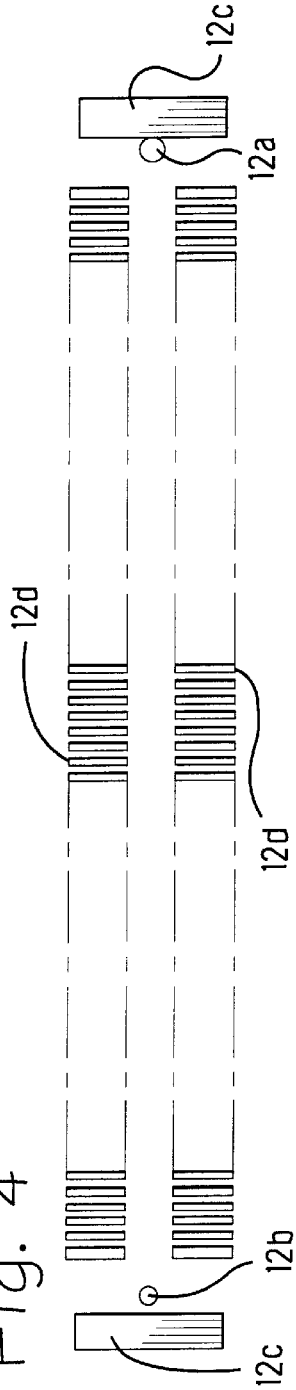
Figure 10:
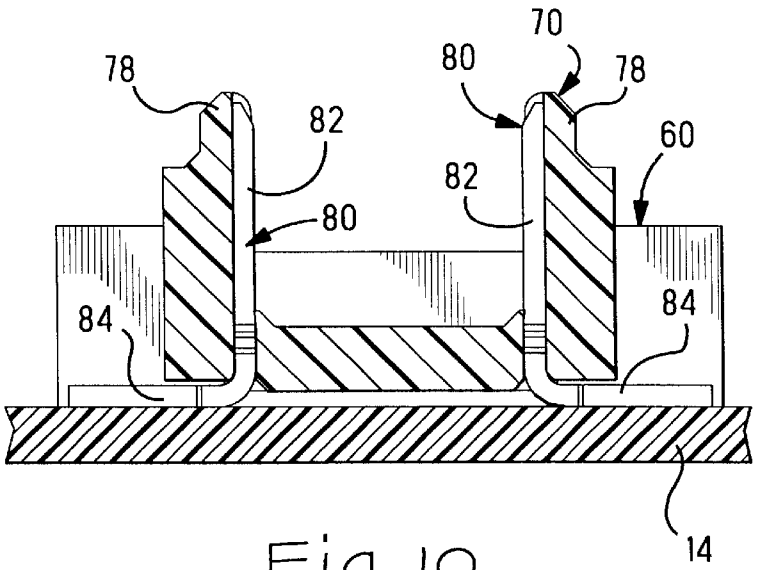
FIG. 10 is a cross-sectional view of the cap connector shown in FIGS. 6–9.
Figure 5:
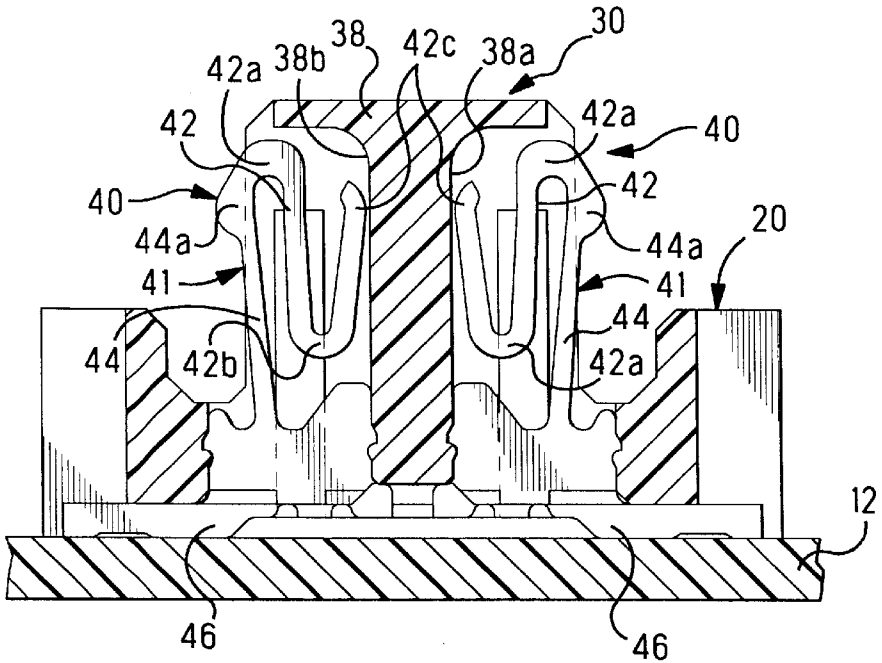
FIG. 5 is a cross-sectional view of the plug connector shown in FIGS. 1–4.
Figure 8:
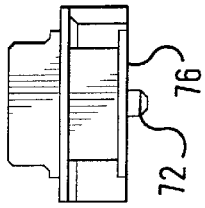
FIGS. 6–9 illustrate the cap connector of the electrical connector of the present invention.
Figure 6:
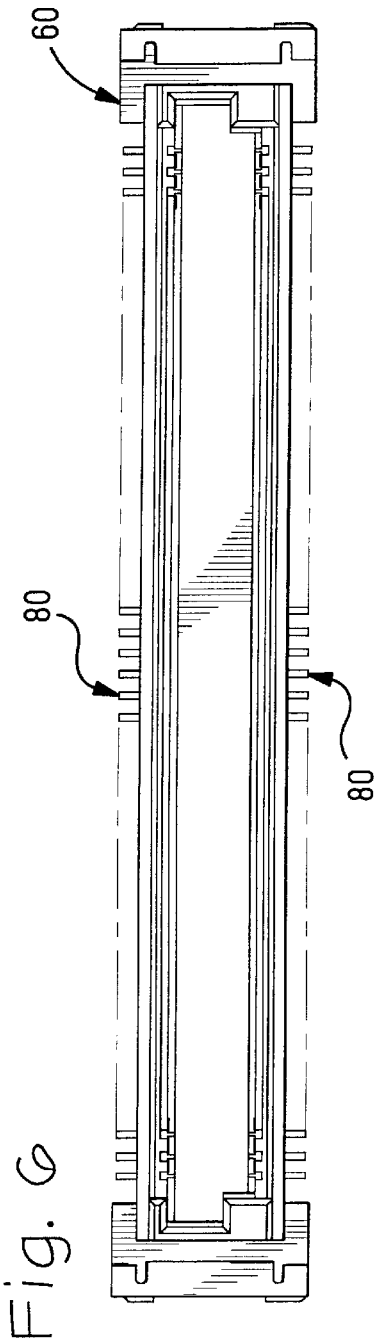
Figure 7:
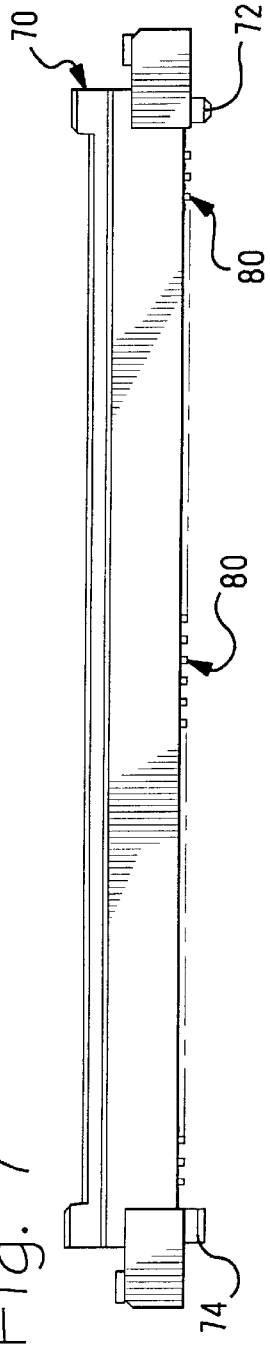
Figure 9:
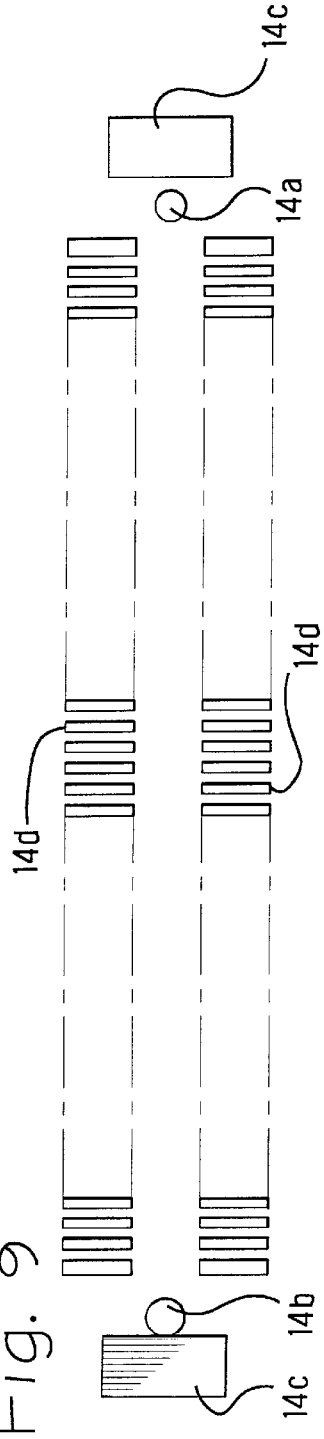

The cap connector 60 is equipped with a housing 70 and contacts 80. The contacts 80 are lined up in two rows along the length of the housing 70. The housing 70 is equipped with posts 72 and 74 as shown in FIG. 7 which are respectively inserted into post holes 14*a* and 14*b* formed in the board 14, and a metal-fastening fitting 76 which is soldered to a fastening pad 14*c* on the board 14. Furthermore, side walls 78 which extend in the direction of length of the housing 70 are formed on both side portions of the housing 70. Contacts 80 are comprised of contact sections 62 which electrically contact the contact projections 44*a* of the second spring members 44 of the contacts 40, and termination sections 84 which are soldered to conductive pads 14*d* on the board 14. The contacts 80 are formed by stamping and bending single metal plates which are superior in terms of conductivity and spring characteristics. The contacts 80 are installed at a pitch of 0.6 mm, and the height of the contacts 80 from the board 14 is approximately 3.0 mm.

When the plug connector 20 and cap connector 60 are connected, as shown in FIG. 11, the first and second spring members 42 and 44 of the contacts 40 are clamped between the wall surfaces 38*a* and 38*b* and the contact sections 82 of the contacts 80. Furthermore, when the contact projections 44*a* of the second spring members 44 are pressed against the contact sections 82 of the contacts 80, the first and second spring members 42 and 44 apply a force on the contacts 80. Thus, when the plug connector 20 and cap connector 60 are connected, the contacts 40 are clamped between the wall surfaces 38*a* and 38*b* and the contacts 80, and are strongly pressed against both the wall surfaces 38*a* and 38*b* and contacts 80. Accordingly, even if the contacts 40 are made smaller and shorter in order to reduce the pitch of the contacts 40, the contacts 40 and contacts 80 electrically and wipingly contact each other with a high contact pressure. Furthermore, since the contacts 40 are arranged in two rows so that the first and second spring members 42 and 44 of the contacts 40 are mutually symmetrical in the opposing rows, the respective forces between contacts 40 and 80 are balanced between the rows of contacts 40, so that the contacts 40 and contacts 80 contact each other with a high well-balanced contact pressure, thus making it possible to obtain an electrical connector which provides secure electrical connections.

A second embodiment of the electrical connector of the present invention will be described with reference to FIGS. 12–15:

The electrical connector of the second embodiment is characterized by the shape of the cap connector. The plug connector has the same shape as the plug connector in the first embodiment. Accordingly, the cap connector will be described here.

The cap connector 90 is equipped with a housing 100 and contacts 120. The contacts 120 are lined up in two rows along the length of the housing 100. Compared to the contacts 80 of the cap connector 60 shown in FIGS. 6–9, the contacts 120 are longer, with a length of approximately 9.00 mm. The housing 100 is equipped with posts 102 and 104 which are respectively inserted into post holes 14*a* and 14*b* formed in the board 14, and a metal-fastening fitting 106 which is soldered to a fastening pad 14*c* on the board 14. Furthermore, side walls 108 extend in the direction of the length of the housing 100 and are formed with openings 108*a*. These openings are a characteristic feature of the cap connector 90. The reason for forming the openings 108*a* will be described below.

The housing 100 is ordinarily made of a synthetic resin, and is formed by injection molding using a mold which corresponds to the shape of the housing 100. The contacts 120 are inserted into the housing 100 after the housing 100 has been molded. The spaces into which the contacts 120 are inserted are formed in the injection-molded walls of the housing 100 using long, slender pins known as core pins. After the housing 100 has been injection-molded, these core pins are removed from the housing 100. In cases where the contacts 120 are long, the core pins are also naturally long, so that there is a danger that bending will occur when the core pins are pulled out of the housing 100. Accordingly, the openings 108*a* are formed in the side walls 108 of the housing 100 in order to allow shortening of the core pins even in cases where the contacts 120 are long. By thus forming the openings 108*a*, it is possible to use a metal mold in the areas corresponding to the openings 108*a* during injection molding. Furthermore, two short core pins which are respectively inserted from above and below are used in each area corresponding to a space into which one of the contacts 120 is to be inserted. By thus using two short core pins to form spaces for the insertion of long contacts, it is possible to prevent bending of the core pins when they are pulled out of the housing 100 following injection molding.

Figure 16:
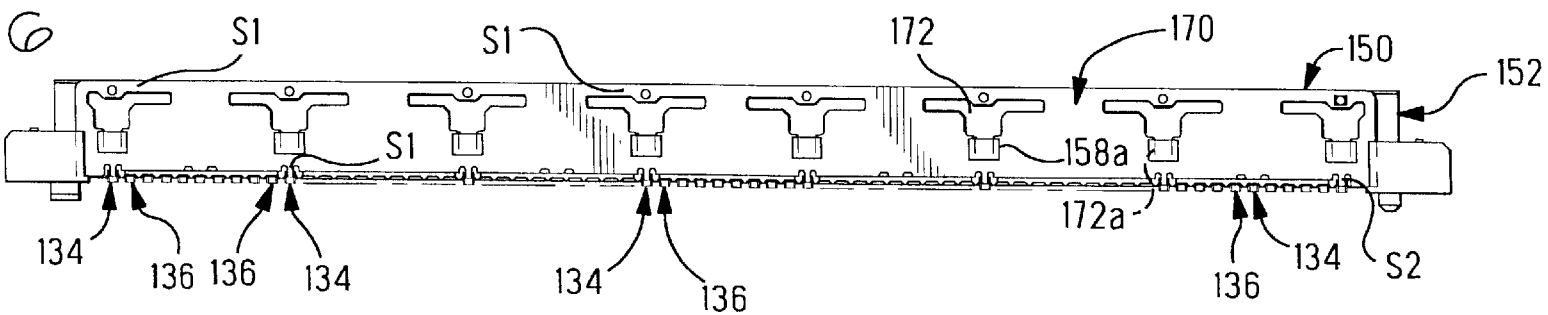
FIG. 16 is a side view which illustrates the cap connector in a third embodiment of the electrical connector of the present invention.
Figure 15:
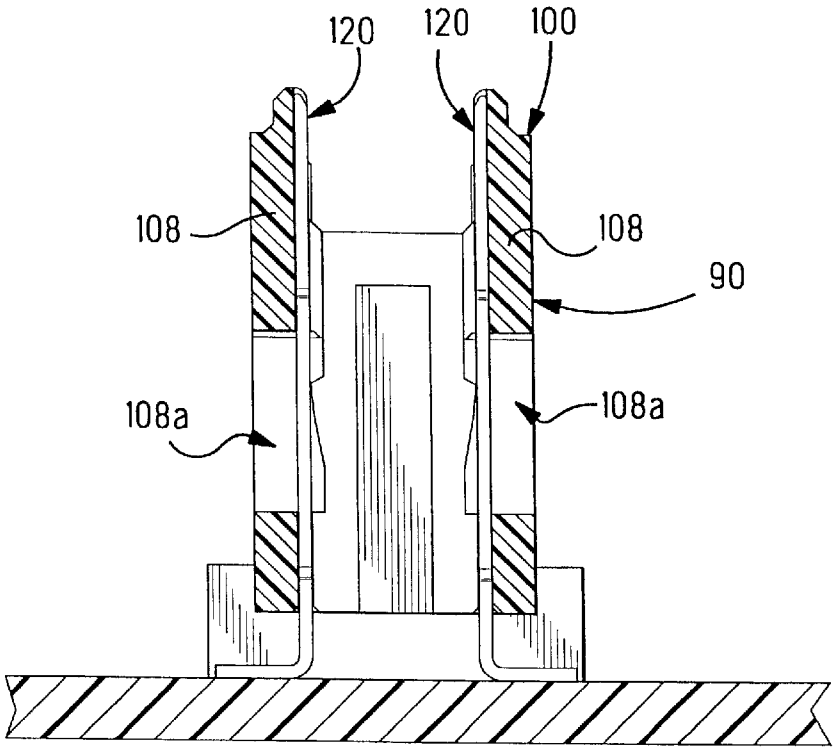
FIG. 15 is a cross-sectional view of the cap connector shown in FIGS. 12–14.
Figure 17:
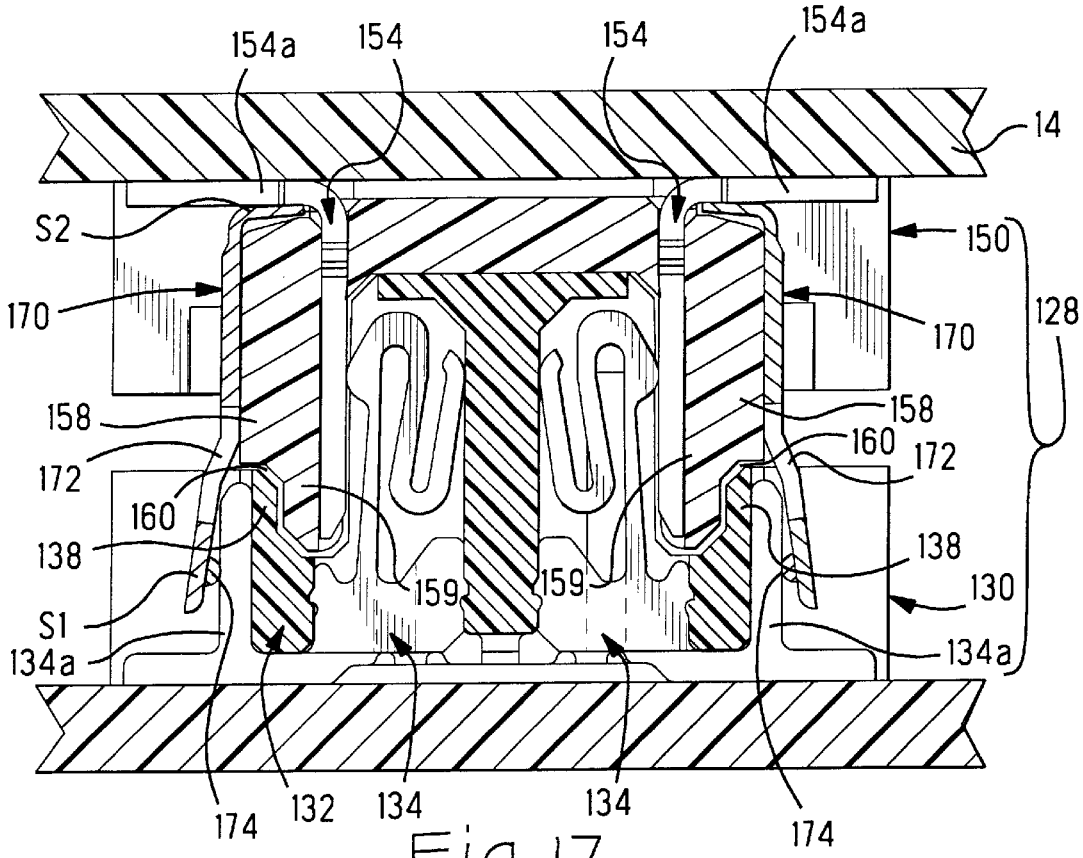
FIG. 17 is a cross-sectional view which shows the. cap connector in FIG. 16 connected with a plug connector, illustrating the electrical contact between the ground contacts of the cap connector and the ground contacts of the plug connector.
Figure 18:
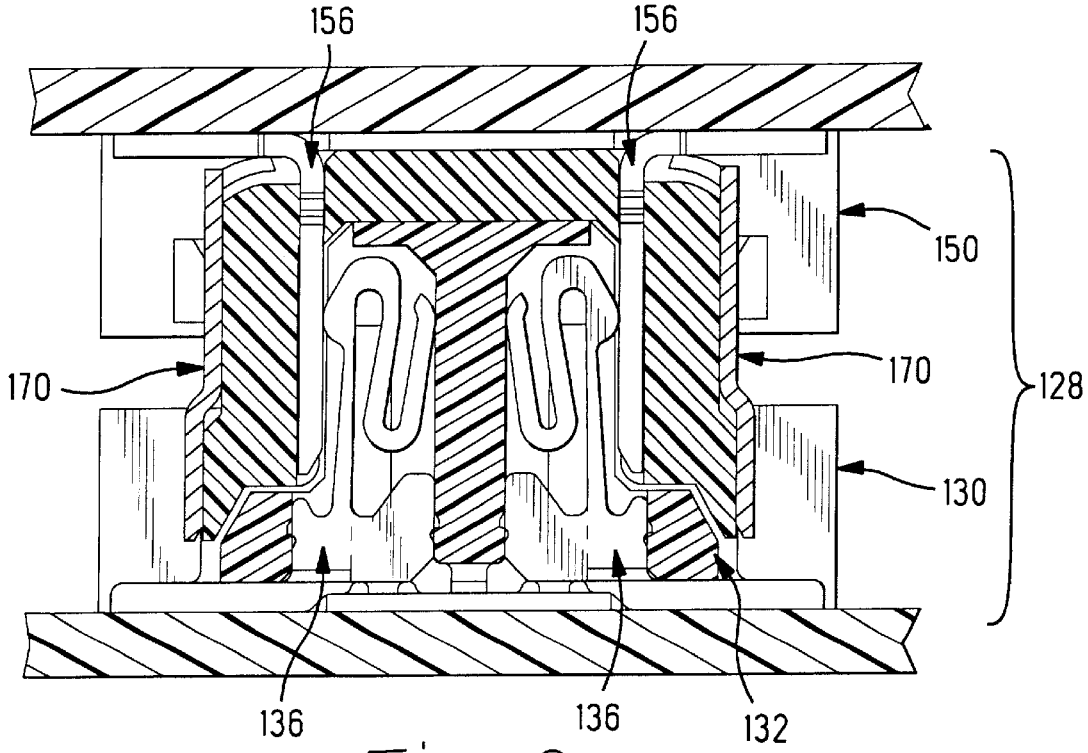
FIG. 18 is a cross-sectional view which shows the cap connector in FIG. 16 connected with a plug connector, illustrating the electrical contact between the signal contacts of the cap connector and the signal contacts of the plug connector.

A third embodiment of the electrical connector of the present invention will be described with reference to FIGS. 16–18.

The electrical connector 128 of the third embodiment is characterized by shield plates 170 which are attached to the side surfaces of walls 158 of the housing 152 of the cap connector 150, and by the shape of the ground contacts among the contacts of the plug connector.

The electrical connector 128 of the third is embodiment is equipped with a plug connector 130 and a cap connector 150 which are substantially similar in shape to the plug connector 20 and cap connector 60 of the electrical connector 10 of the first embodiment illustrated in FIGS. 1 through 11. Ground contacts 134 and signal contacts 136 are arranged in the housing 132 of the plug connector 130. Furthermore, ground contacts 154 and signal contacts 156 are also arranged in the housing 152 of the cap connector 150. Moreover, shield plates 170 are respectively attached to both side surfaces of walls 158 of the housing 152 of the cap connector 150. This attachment is accomplished by causing the shield plates 170 to slide relative to the housing 152 so that respective projections 158*a* formed on the side surfaces of walls 158 enter the narrow portions 172*a* of slots 172 formed in the shield plates 170. Bridge contact sections S1 (supported at both ends) on which dimples 174 are formed, and tongue members S2 which are used to make spring contact with the ground contacts 154 of the cap connector 150, are formed on the shield plates 170.

When the plug connector 130 and cap connector 150 are connected, the bridge contact sections S1 of the shield plates 170 contact the extensions 134*a* of the ground contacts 134, and the tongue members S2 springably contact the termination sections 154*a* of the ground contacts 154. If necessary, the tongue members S2 and the termination sections 154*a* of the ground contacts 154 may be soldered. Furthermore, in the assembly process, the termination sections 154*a* of the ground contacts 154 are soldered to the conductive pads 14*d* on board 14. Accordingly, the heat generated when the cap connector 150 is mounted on the board 14 may be utilized in order to solder the tongue members S2 and the termination sections 154*a* of the ground contacts 154. As is shown in FIG. 18, the signal contacts 136 and 156 do not contact the shield plates 170. Furthermore, the housing 152 of the cap connector 150 has projecting portions 159, and grooves 160 which accommodate the projecting portions 138 of housing 132 at which the contact sections S1 and extensions 134*a* are located. The assembly process is as follows: The shield plates 170 are first attached to the housing 152 of the cap connector 150, after which the contacts 154 and 156 are positioned into the housing 152. Soldering is performed only when the cap connector 150 is attached to the board. Dimples 174 are formed in the shield plate 170, and these dimples 174 electrically contact the extensions 134*a* of the ground contacts 134. However, it would also be possible to omit the dimples 174. In the electrical connector of this third embodiment, as was described above, the respective ground contacts 134 and 154 can easily be connected by attaching a single shield plate 170 to the housing 152 of the cap connector 150.

Figure 19:
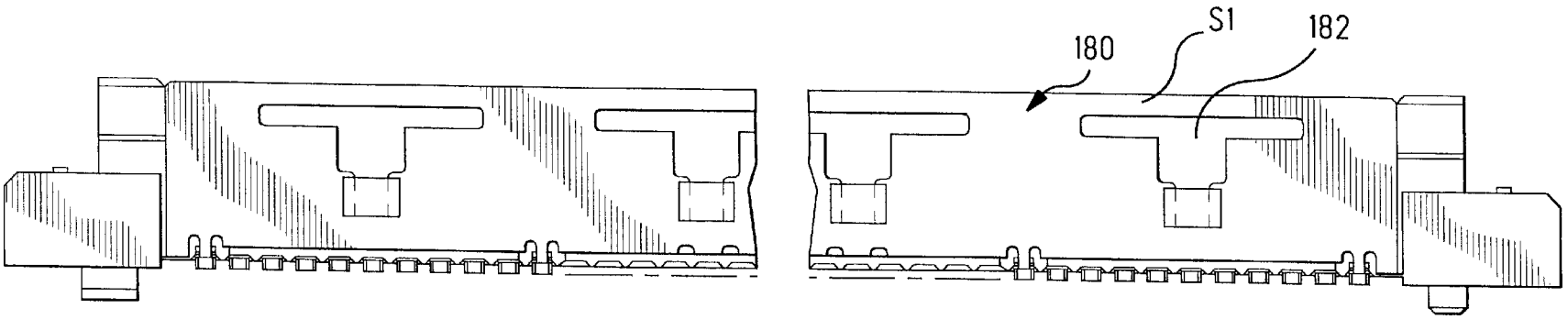
FIG. 19 is a side view which illustrates the cap connector in a fourth embodiment of the electrical connector of the present invention.

FIG. 19 illustrates a fourth embodiment of the electrical connector of the present invention. The difference between this electrical connector and the electrical connector of the third embodiment lies in the shape of the shield plates. In the shield plates 180 of the electrical connector of this fourth embodiment, no dimples are formed in the bridge contact sections in order to prevent sagging of the slots 182. An effect similar to that obtained using the shield plates 170 shown in FIG. 16 can also be obtained using these shield plates 180.

In the electrical connector of the present invention, as was described above, the first contacts are clamped between the wall surfaces and the second contacts, and are thus strongly pressed against both the wall surfaces and the second contacts, when the first and second connectors are connected to each other. Accordingly, even in cases where the contacts are made smaller and shorter in order to reduce the pitch of the contacts, the first contacts and second contacts can be caused to electrically contact each other with a high contract pressure. Furthermore, since the first contacts are lined up in two rows so that the first and second spring members are mutually symmetrical in the opposing rows, the respective forces from the wall surfaces and the second contacts are balanced between the two rows, so that the first contacts and second contacts can be electrically connected to each other with a high, well-balanced contact pressure, thus making it possible to obtain an electrical connector which provides a secure electrical connection.

I claim:

1. An electrical connector having a housing, the housing having at least one sidewall supporting electrical contacts, the connector comprising:

a shield plate extending along an outer surface of the sidewall contacting at least one of the electrical contacts, having a plurality of openings each opening having a wide portion and a narrow portion for receiving a projection extending from the sidewall; the shield plate having bridge contact sections extending along the openings opposite the narrow portions.

2. The electrical connector of claim 1 wherein the bridge contact sections further comprise a dimple located on a surface thereof.

3. The electrical connector of claim 1 wherein the shield plate further comprises at least one tongue member for engaging one of the electrical contacts.

4. An electrical connector having a housing supporting a plurality of contacts, the connector comprising:

a shield plate extending along an outer surface of the housing, the shield plate having a bridge contact section formed across a wide portion of an opening for contacting a complementary ground contact positioned on a mating connector, the opening having a narrow portion for receiving a projection extending from the housing.

5. The electrical connector of claim 4 further comprising a dimple formed on the bridge contact section.

6. The electrical connector of claim 4 further comprising a tongue member extending from the shield plate to engage one of the plurality of contacts.

* * * * *